US012660869B2

(12) United States Patent
Kim

(10) Patent No.: US 12,660,869 B2
(45) Date of Patent: Jun. 23, 2026

(54) PROTECTION PAD

(71) Applicant: TANNUS CO., LTD., Gimhae-si (KR)

(72) Inventor: Young-Dong Kim, Gimhae-si (KR)

(73) Assignee: TANNUS CO., LTD., Gimhae-si (KR)

( * ) Notice: Subject to any disclaimer, the term of this patent is extended or adjusted under 35 U.S.C. 154(b) by 46 days.

(21) Appl. No.: 18/716,209

(22) PCT Filed: Dec. 27, 2022

(86) PCT No.: PCT/KR2022/021426
§ 371 (c)(1),
(2) Date: Jun. 4, 2024

(87) PCT Pub. No.: WO2023/128572
PCT Pub. Date: Jul. 6, 2023

(65) Prior Publication Data

US 2025/0040632 A1 Feb. 6, 2025

(30) Foreign Application Priority Data

Dec. 27, 2021 (KR) ..... 10-2021-0188289

(51) Int. Cl.
*A41D 13/015* (2006.01)
*A41D 13/05* (2006.01)

(52) U.S. Cl.
CPC ..... *A41D 13/0158* (2013.01); *A41D 13/0506* (2013.01); *A41D 13/05* (2013.01)

(58) Field of Classification Search
CPC ..... A41D 2400/80
See application file for complete search history.

(56) References Cited

U.S. PATENT DOCUMENTS 4,847,913 A * 7/1989 Chen ..... A41D 13/0156 2/92
4,868,926 A * 9/1989 Lowson ..... A63B 71/1225 2/22
5,924,140 A * 7/1999 Chi ..... A41D 13/08 2/24
6,093,468 A * 7/2000 Toms ..... A41D 31/14 2/22
6,295,654 B1 * 10/2001 Farrell ..... A41D 13/0158 2/108
6,519,781 B1 * 2/2003 Berns ..... A41D 13/0153 2/455
7,329,230 B2 * 2/2008 Mazzarolo ..... A63B 71/12 2/455
8,764,931 B2 * 7/2014 Turner ..... A43B 13/187 156/265

(Continued)

FOREIGN PATENT DOCUMENTS

CA 2249258 A1 9/1997
EP 1369149 A1 12/2003

(Continued)

*Primary Examiner* — Jocelyn Bravo
(74) *Attorney, Agent, or Firm* — Bridgeway IP Law Group, PLLC; Jihun Kim

(57) ABSTRACT

A body protection pad is described, and the body protection pad includes a plurality of main parts each including a vent formed in the front and rear direction and a circumference surrounding the vent; and groove part parts concavely formed from the front to the rear between the plurality of main parts.

8 Claims, 4 Drawing Sheets

(56) References Cited

U.S. PATENT DOCUMENTS

| | | | | |
|---|---|---|---|---|
| 12,144,386 | B2 * | 11/2024 | Larson | A41D 13/015 |
| 2005/0234380 | A1 * | 10/2005 | Fulford | A41D 13/0158 602/61 |
| 2006/0179538 | A1 * | 8/2006 | Dodd | A41D 13/0543 2/22 |
| 2006/0210766 | A1 * | 9/2006 | Press | A41D 31/04 427/256 |
| 2011/0281083 | A1 * | 11/2011 | Kim | A41D 13/08 428/189 |
| 2012/0084896 | A1 * | 4/2012 | Wyner | B32B 5/02 2/24 |
| 2014/0259324 | A1 * | 9/2014 | Behrend | A41D 13/0543 2/455 |
| 2014/0259325 | A1 * | 9/2014 | Behrend | A41D 13/06 2/455 |
| 2015/0082523 | A1 * | 3/2015 | Wyner | B32B 7/12 2/455 |
| 2016/0192714 | A1 * | 7/2016 | Williams | A41D 13/015 2/455 |
| 2021/0059326 | A1 * | 3/2021 | Larson | A41D 13/0156 |
| 2023/0232915 | A1 * | 7/2023 | Larson | A41D 13/0153 2/455 |

FOREIGN PATENT DOCUMENTS

| | | | |
|---|---|---|---|
| EP | 3473120 | A1 | 4/2019 |
| JP | H06504689 | A | 6/1994 |
| JP | H11506176 | A | 6/1999 |
| JP | 2000-005370 | A | 1/2000 |
| JP | 2003-105607 | A | 4/2003 |
| JP | 2011-140736 | A | 7/2011 |
| JP | 2015507104 | A | 3/2015 |
| KR | 10-2014-0119175 | A | 10/2014 |
| KR | 10-1585580 | B1 | 1/2016 |
| KR | 10-2002923 | B1 | 7/2019 |
| KR | 10-2021-0093480 | A | 7/2021 |
| WO | 2021/050842 | A1 | 3/2021 |

* cited by examiner

PROTECTION PAD

TECHNICAL FIELD

The present invention relates to a protection pad for protecting a body.

BACKGROUND ART

As quality of life and medical technology improve, modern society has entered an aging society with an increase in average life expectancy. On the other hand, as people enter the elderly age group, the people suffer from various diseases and take medicine for treatment purposes, and the decline in immunity due to the side effects may increase.

Meanwhile, as bones become weaker, fractures are more likely to occur from even minor collisions. More than fractures in other parts of the body, fractures of the hip, sacrum, and coccyx caused by falls can be said to be very dangerous fractures because they make walking difficult. Among them, hip fractures in particular have a higher risk than other fractures.

In addition, when the fracture occurs, surgery is required and various complications may occur as a result of the inability to walk. Elderly people with poor healing ability or those with weak bodies may need a long period of time after surgery to return to normal, and sometimes the elderly people with poor healing ability or those with weak bodies may not recover.

For this reason, it is necessary to wear a protector to protect the bones in the event of a collision to prevent damage to the bones due to the impact.

In this regard, various types of protectors are currently disclosed, and the most common are pants-type and band-type ones in which an elastic pad with a cushioning effect is attached to the inside of the fabric to protect the hip joint, sacrum, and coccyx area, and as a material of the pad, soft rubber, foam rubber, or thickly laminated fibers are used in various shapes.

However, conventional protectors are not easy to deform, resulting in inconvenience when worn.

Prior art related to this is disclosed in Korean Patent Registration No. 10-2002923.

DISCLOSURE

Technical Problem

The present invention is contrived to solve the problems in the related art, and an object of the present invention is to provide a body protection pad that is easier to deform and improves wearability compared to the related art.

However, a technical object to be achieved by the exemplary embodiment of the present invention is not limited to the technical objects and there may be other technical objects.

Technical Solution

As a technical means for achieving the technical object, a body protection pad according to a first aspect of the present invention may include a plurality of main parts each including a vent formed in the front and rear direction and a peripheral portion surrounding the vent; and groove parts concavely formed from the front to the rear between the plurality of main parts.

The above-described task resolution means is only an exemplary and should not be interpreted as the intention to restrict the present invention. In addition to the exemplary embodiments described above, there may be additional exemplary embodiments in drawings and the detailed description of the present invention.

Advantageous Effects

According to a technical solution of the present invention, a groove part having a thinner thickness than the plurality of main parts is formed between the plurality of main parts, so a protection effect (buffering effect) occurs in the main part, and the pad is easily deformed along the groove part. As a result, the deformability of the pad is higher compared to the case where the groove part is not formed, so the wearing comfort can be improved and the wearer's activity can be secured.

In addition, according to the above-described technical solution of the present invention, vents are formed in the main part, so ventilation can be secured.

BEST MODE

Figure 1:
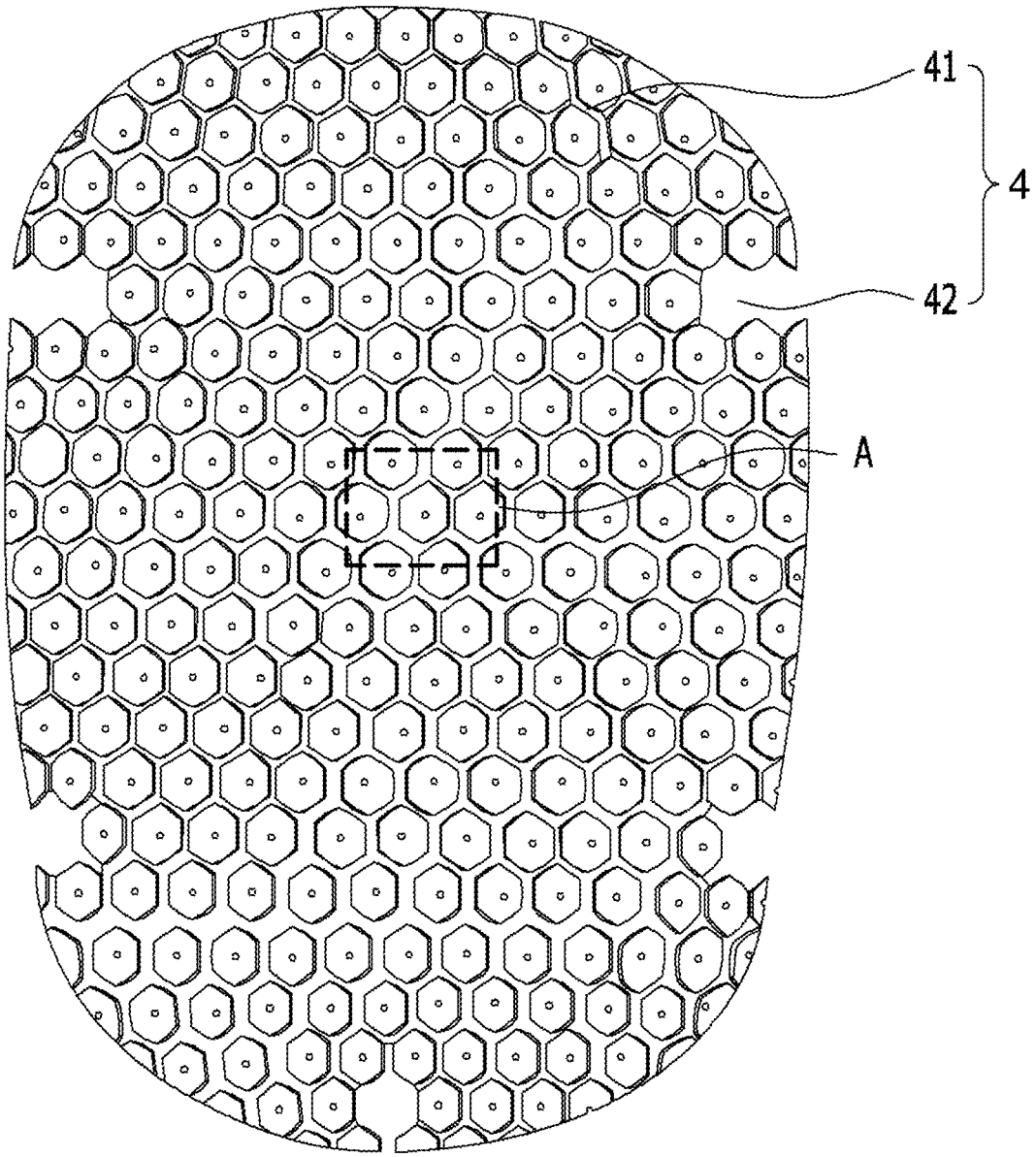
FIG. 1 is a front view of a body protection pad according to an exemplary embodiment of the present invention.

Hereinafter, exemplary embodiments of the present invention will be described in detail so as to be easily implemented by those skilled in the art, with reference to the accompanying drawings. However, the present invention may be implemented in various different forms and is not limited to exemplary embodiments described herein. In addition, in the drawings, in order to clearly describe the present invention, a part not related to the description is not omitted and like reference numerals designate like elements throughout the present invention.

Throughout the specification of the present invention, when it is described that a part is "connected" with another part, it means that the certain part may be "directly connected" with another part and the elements "electrically connected" to each other with a third element interposed therebetween as well.

Throughout this specification, it will be understood that when a member is referred to as being "on", "at an upper portion of", "on the top of", "beneath", "at a lower portion of", and "on the bottom of" another member, it can be directly on the other member or intervening members may also be present.

Throughout the specification of the present invention, unless explicitly described to the contrary, the word "comprise" and variations such as "comprises" or "comprising" will be understood to imply the inclusion of stated elements but not the exclusion of any other elements.

For reference, in the description of the exemplary embodiments of the present invention, terms related to direction or location (front, front side, front side portion, rear, rear side, rear side portion, etc.) are set based on the arrangement status of each component illustrated in the drawings. For example, looking at FIG. 3, a general 12 o'clock direction may be a front, a side generally facing the 12 o'clock direction may be a front side, a portion generally facing the 12 o'clock direction may be a front side portion (front end), and a general 6 o'clock direction may be a rear, a side generally facing the 6 o'clock direction may be a rear side, and a portion generally facing the 6 o'clock direction may be a rear side portion (rear end).

The present invention relates to a body protection pad.

First, a body protection pad (hereinafter, referred to as 'the pad') according to an exemplary embodiment of the present invention will be described.

Figure 2:
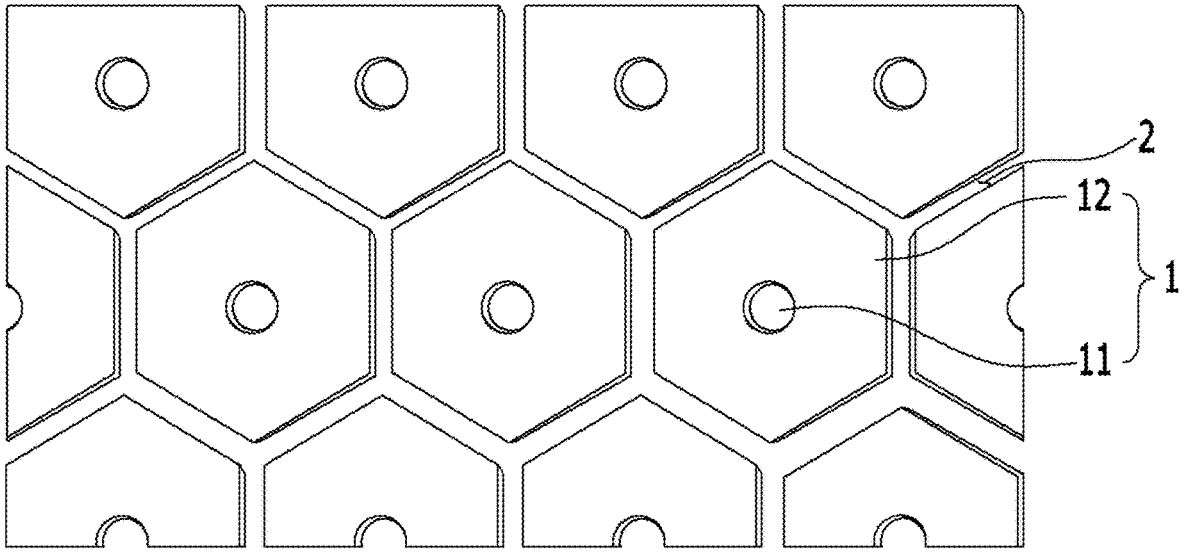
FIG. 2 is an enlarged diagram of A in FIG. 1.

Referring to FIGS. 1 and 2, the pad includes a plurality of main parts 1. The main part 1 includes a vent 11 formed in a front and rear direction and a peripheral portion 12 surrounding the vent 11.

The vent 11 may ensure ventilation. Further, a cross-section of the vent 11 may be various, such as circular, oval, polygonal, or star-shaped.

In addition, referring to FIG. 2, at least some of the plurality of main parts 1 may have a hexagonal circumference. In other words, among the plurality of main parts 1, a main part 1 provided on an outer peripheral portion (rim portion) in a current direction (or diagonal direction) crossing the center of the pad and the remaining main parts 1 with an attachment promoting part 4 to be described later, except for the main part 1 may have the hexagonal circumference. Accordingly, this pad is enabled to be deformed (bent) with free directionality. In addition, the shape of the circumference of the plurality of main parts 1 may be one or more of triangles, pentagons, and hexagons, but is not limited thereto. That is, the plurality of main parts 1 may include one or more of a main part with a triangular cross-section, a main part with a pentagonal cross-section, and a main part with a hexagonal cross-section.

Further, when worn on the body, the pad may be placed on the body with the rear side facing the body.

Figure 3:
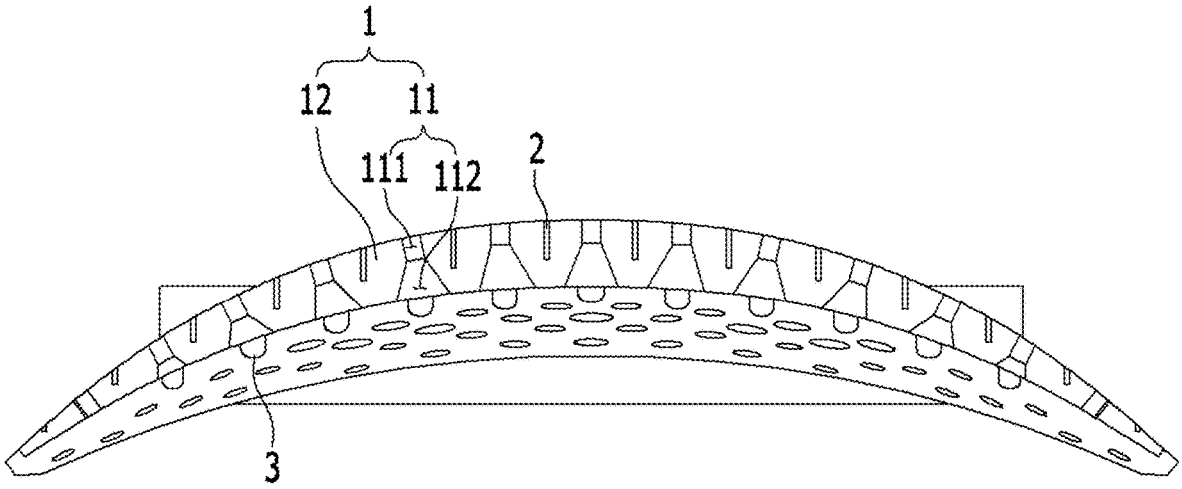
FIG. 3 is a schematic conceptual cross-sectional view of the body protection pad in a front and rear direction according to an exemplary embodiment of the present invention.

Referring to FIG. 3, a diameter of a rear end 112 of the vent 11 may be larger than a diameter of a front end 111. Further, the vent 11 may have a trumpet shape whose cross-section becomes wider as the rear end 112 moves toward the rear. As described above, the pad may be placed on the body with the rear side facing the body, so the rear side may be closer to the body than the front side and may receive more heat from the human body than the front side. Accordingly, the rear end 112 of the vent 11 may be closer to the human skin than the front end 111 (the rear side of the pad is a portion located on the human body, a portion (surface) in contact with the human skin), so for ventilation of heat, the rear end 112 preferably has a trumpet shape with a cross-sectional area that increases toward the rear.

Further, the vent 11 may have a cylindrical shape in which the front end 111 has a constant cross-section in the front and rear direction. Since the rear end 112 of the vent 11 is cone-shaped, an epidermal layer of the rear side portion where the rear end 112 of the vent 11 of the pad is formed may be thin. Considering this, since the front end 111 is formed as a cylindrical hole, the front side portion where the front end 111 of the vent 11 of the pad is formed may have a thicker epidermal layer than the rear side portion, and may serve as a shock absorbing layer to absorb shock. For reference, the front end 111 may have a depth of 2.5 mm in the front and rear direction.

Further, referring to FIG. 3, the pad may include a plurality of wearing support parts protruding rearward from the rear side so that the pad is supported by a wearer. That is, the wearing support part may include a protrusion 3. Specifically, the pad may include a plurality of protrusions 3 that protrudes rearward from the rear side to support the rear side for the wearer. An outer surface of the protrusion 3 may be curved. That is to say, the cross-section of the protrusion 3 may be semicircular. The protrusion 3 may serve as an embossing, and may further ensure ventilation by separating the rear side of the pad from the wearer (for example, human skin). Further, the protrusion 3 may serve as a shock absorbing layer that absorbs shock. Further, in addition to the protrusion 3, the wearing support part may also be provided in the form of a bone protruding rearward.

Further, the pad includes a groove part 2 that is concavely formed from the front side to the rear between the plurality of main parts 1. A width of the groove part 2 (in other words, a gap between the main parts 1) may be approximately 1 mm. By setting this gap, the main parts 1 are distinguished from each other, and the gap between the main parts 1 is narrowed, so that a hexagonal mark of the main part 1 does not appear on the clothes located on the pad.

Further, referring to FIG. 1, the pad may have a curved shape that protrudes from the center in the plane direction as it moves outward in the plane direction of the pad. Accordingly, the pad may easily be in close contact with a portion where the pad is to be mounted. Specifically, the pad may be designed to be easily in close contact with the hip joint structure. Further. the pad may be designed to be easily in close contact with the thigh structure. In other words, the pad may be designed to be easily in close contact with the hip joint and thigh structures.

In addition, referring to FIG. 3, the thickness of the pad may become thinner as it moves toward the outer side of the pad in the plane direction (in other words, the outer side of the current direction crossing the center of the pad). Accordingly, the pad may not be visible on the upper side of the clothing on the pad. For example, when the pad is worn inside underwear, the visible wearing of the pad (revealing that the pad is worn) can be prevented. Further, depending on the location, some of the plurality of main parts 1 may have different thicknesses from other portions. For example, the main part 1 located on the outer side of the pad in the plane direction may have a thinner thickness compared to the main part 1 located on the inner side of the main pad in the plane direction. Further, depending on the location, some of the plurality of main parts 1 may have different areas from other portions.

In addition, as described above, the pad may include a plurality of protrusions 3 that protrudes rearward from the rear side to support the rear side with respect to the wearer, and the protrusions 3 may not be formed on the outer peripheral portion that is the portion facing the outer side in the current direction.

Further, referring to FIG. 3, the groove part 2 may be concavely formed from the front side to the rear in parallel with the front and rear direction.

In addition, the pad may be a plane shape as a plane. Alternatively, the pad may have a curved shape that protrudes rearward from the center in the plane direction as it moves outward in the plane direction of the pad. Specifically, the pad may have a curved shape in which the front-back-direction cross-section protrudes rearward as it faces both outer sides in the width direction, and even in this case, the groove part 2 may be formed parallel to the front and rear direction. Accordingly, even though the pad has the curved shape in which the front-back-direction cross-section protrudes rearward as it faces both outer sides in the width direction, the width of some of the groove parts 2 is different from the width of the other parts, that is, the gap between the main parts 1 can be prevented from widening, and the productivity of the pad can be facilitated. Alternatively, the pad may be shaped to correspond to the body part so as to engage with the body part on which the pad is worn.

Further, a cross-sectional size of at least some of the plurality of main parts 1 may be different from those of other parts so that the width of some of the groove parts 2 corresponds to the width of other parts.

Figure 4:
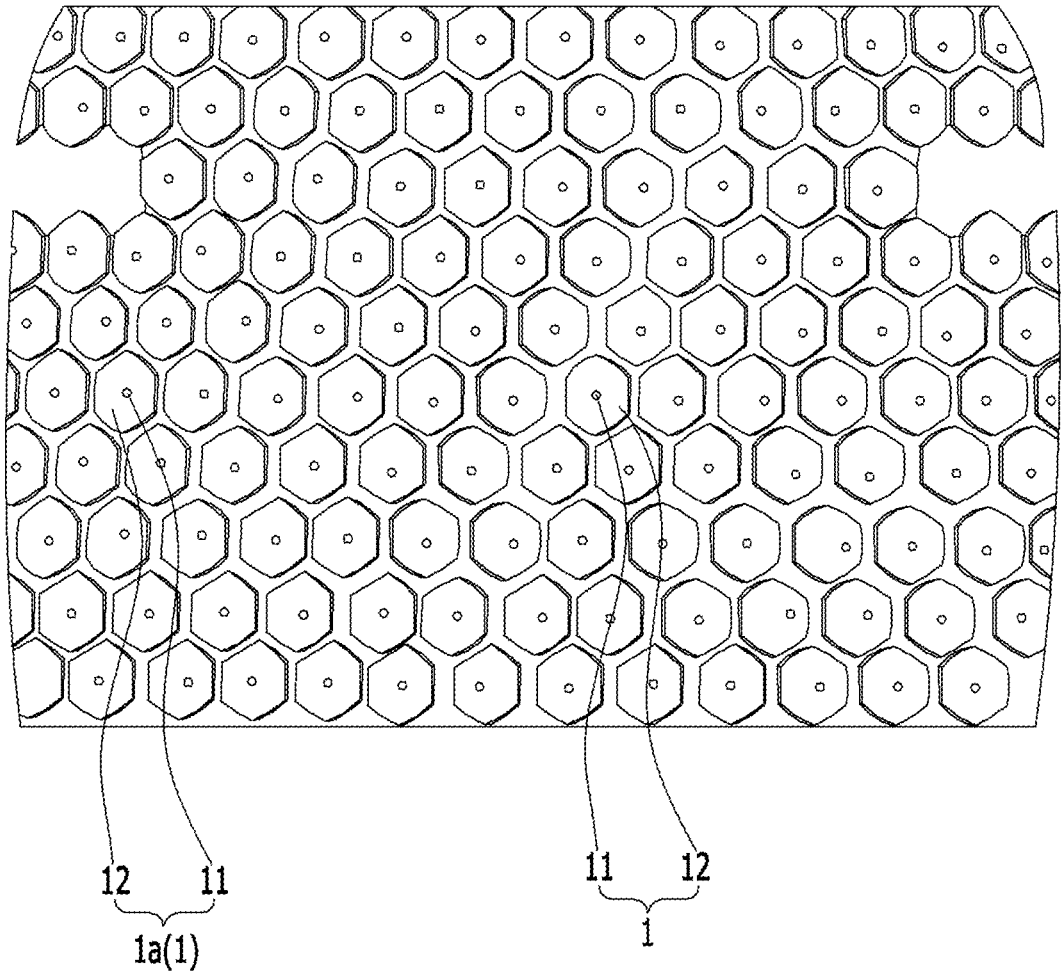
FIG. 4 is an enlarged diagram of a part of the body protection pad according to an exemplary embodiment of the present invention.

For example, referring to FIG. 4, the size of the cross-sectional area of the main part 1 located in the middle part (central part) of the pad and the size of the cross-sectional area of the main part 1*a* located in the outer peripheral portion of the pad may be different from each other. The main part 1 may decrease in size toward the outer circumference of the pad. Alternatively, the size of the cross-sectional area of the main part 1 located in the middle part (central part) of the pad may be larger than the size of the cross-sectional area of the main part 1*a* located in the outer peripheral portion of the pad. Alternatively, main parts 1 neighboring to each other may have different sizes. Specifically, since the main part 1 has the hexagonal circumference, the main part 1 may have six neighboring main parts 6, and the main part 1 may have different sizes from six neighboring main parts 6. The reason may be that as the pad has the curved shape in which the front-back-direction cross-section protrudes rearward as it faces both outer sides in the width direction, the cross-sectional areas of the main parts 1 should be differently set so that the width of the groove part 2 is formed constant, that is, the gap between the main parts 1 is maintained constant. That is, the front side of the main part 1 may be curved, and in order to maintain a constant tight spacing (width of the groove part 1) between the main parts 1 on the curved surface, it is preferable that the cross-sectional size of at least some of the plurality of main parts 1 is different from the cross-sectional size of other parts.

Further, as another example, some of the groove parts 2 may have a different width from other parts of the groove parts 2 depending on the shape and cross-sectional area of the main part 1 neighboring to some of the groove parts 2. Further, depending on the location, some of the groove parts 2 may be set to have a different depression depth from other portions of the groove parts 2.

In addition, referring to FIG. 1, the pad may include the attachment promoting part 4 including one or more of an incision line 41 in which a portion is cut out and an incision groove part 42 formed by a space in which a portion is removed. For example, the attachment promoting part 4 may be formed to be depressed inward from the outer circumference in a current direction crossing the center of the pad (that is, in the plane direction of the pad). The attachment promoting part 4 may make it easier to deform the pad compared to the case where the attachment promoting part 4 is not formed. Accordingly, the attachment promoting part 4 may relieve discomfort when wearing the pad. Further, the incision line 41 and the incision groove part 42 may be formed not only on the outer portion of the pad in the plane direction but also on the inner portion in the plane direction. Further, the incision line 41 may be formed along the groove part 2. In addition, the incision groove part 42 may be in the shape of the main part 1. In this case, the incision groove part 42 may be formed by removing the main part 1.

As described above, the attachment promoting part may include a tearing groove part 41 formed in a cut shape with a predetermined section directed inward from the outer circumference of the pad of the groove part 2. Further, the attachment promoting part may include a tearing recess 42 formed by removing one or more of the plurality of main parts 1 located on the outer circumference of the pad.

Further, the pad may be accommodated in clothing and worn on the wearer. In addition, the pad may be worn with the rear side facing the body. That is to say, the pad may be inserted between clothes and the body, in a pocket formed on clothes, etc., and worn on the wearer. Alternatively, the pad may include a wearing member that attaches the pad to the wearer. The wearing member may be provided in various forms such as Velcro, a strap member for fastening a buckle belt, etc., thereby allowing it to be worn by the wearer. In this case, a binding string member may be fastened to the pad, and the wearer may fix (wear) the pad to the body by positioning the pad and binding the binding string member to the body.

For reference, this pad may be formed as an integrated piece. Further, the pad may be made of a material containing one or more of natural rubber, synthetic rubber, and foamed olefin. Alternatively, the pad may be made of a material containing soft rubber, foam rubber, or fiber. Further, this pad may be made of an elastic material. Since this is apparent to those skilled in the art, a detailed description will be omitted.

The aforementioned description of the present invention is used for exemplification, and it can be understood by those skilled in the art that the present invention can be easily modified in other detailed forms without changing the technical spirit or requisite features of the present invention. Therefore, it should be appreciated that the aforementioned exemplary embodiments are illustrative in all aspects and are not restricted. For example, respective constituent elements described as single types can be distributed and implemented, and similarly, constituent elements described to be distributed can also be implemented in a coupled form.

The scope of the present invention is represented by claims to be described below rather than the detailed description, and it is to be interpreted that the meaning and scope of the claims and all the changes or modified forms derived from the equivalents thereof come within the scope of the present invention.

The invention claimed is:

1. A body protection pad comprising:

a plurality of main parts, each including a vent arranged in a thickness direction of each of the plurality of main parts and a peripheral portion surrounding the vent; and groove parts concavely defined between the plurality of main parts, the groove parts extending from a front surface of the body protection pad towards a rear surface of the body protection pad, wherein each of the vents includes:

a front end portion having a cylindrical shape with a constant cross-sectional diameter along a front-rear direction; and a rear end portion having a cone-shape in which a cross-sectional diameter of the rear end portion increases toward a rear side of the body protection pad, wherein the body protection pad has a curved shape, in which an outer region of the body protection pad extends more rearward relative to a center of the body protection pad, wherein at least one of the plurality of main parts has a cross-sectional area different from cross-sectional areas of other of the plurality of main parts, such that the groove parts have a constant width between the plurality of main parts.

2. The body protection pad of claim 1, wherein a thickness of the body protection pad decreases from the center of the body protection pad toward the outer region of the body protection pad.

3. The body protection pad of claim 1, wherein the body protection pad further includes a plurality of wearing support parts, each wearing support part including a protrusion protruding rearward from the rear surface of the body protection pad to be supported on a wearer.

4. The body protection pad of claim 1, wherein the plurality of main parts having comprise one or more shapes selected from a triangle, a pentagon, and a hexagon, each of the one or more shapes being defined by a circumference of a respective main part of the plurality of main parts.

5. The body protection pad of claim 1, wherein at least one of the plurality of main parts has a thickness different from thicknesses of other of the plurality of main parts.

6. The body protection pad of claim 5, wherein at least one of the groove parts has a depression depth different from depression depths of other of the groove parts.

7. The body protection pad of claim 1, wherein the body protection pad has an attachment promoting part including one or more of:

incision lines that cut through at least a portion of the body protection pad, and incision groove parts defined by a space in which a portion of the body protection pad is removed.

8. The body protection pad of claim 1, wherein the body protection pad includes a material containing one or more selected from natural rubber, synthetic rubber, and foamed olefin.

* * * * *